US012780595B2

(12) United States Patent
Peng et al.

(10) Patent No.: US 12,780,595 B2
(45) Date of Patent: Nov. 3, 2026

(54) YARN BOX, YARN STRIPPING METHOD, YARN STRIPPING APPARATUS, ELECTRONIC DEVICE AND STORAGE MEDIA

(71) Applicant: Zhejiang Hengyi Petrochemical Co., Ltd., Hangzhou (CN)

(72) Inventors: Xiantao Peng, Hangzhou (CN); Yibo Qiu, Hangzhou (CN); Peng Wang, Hangzhou (CN)

(73) Assignee: Zhejiang Hengyi Petrochemical Co., Ltd., Hangzhou (CN)

( * ) Notice: Subject to any disclaimer, the term of this patent is extended or adjusted under 35 U.S.C. 154(b) by 10 days.

(21) Appl. No.: 18/740,144

(22) Filed: Jun. 11, 2024

(65) Prior Publication Data

US 2025/0100841 A1 Mar. 27, 2025

(30) Foreign Application Priority Data

Sep. 26, 2023 (CN) ..... 202311254021.1

(51) Int. Cl.
*B65H 54/70* (2006.01)
*B65H 54/71* (2006.01)
(Continued)

(52) U.S. Cl.
CPC ..... *B65H 54/705* (2013.01); *B65H 54/707* (2013.01); *B65H 54/71* (2013.01);
(Continued)

(58) Field of Classification Search
CPC ..... B65H 54/547; B65H 54/70; B65H 54/88; B65H 63/086; B65H 2301/4481; D01D 11/00
See application file for complete search history.

(56) References Cited

U.S. PATENT DOCUMENTS 3,955,906 A * 5/1976 Murase ..... B65H 67/0428 425/88
4,043,718 A * 8/1977 Takenaka ..... B65H 75/36 242/476.1
(Continued)

FOREIGN PATENT DOCUMENTS

CN 201428023 Y 3/2010
CN 201753218 U 3/2011
(Continued)

OTHER PUBLICATIONS

Extended European Search Report dated Nov. 20, 2024, in connection with European Application No. 24180030.9.
(Continued)

*Primary Examiner* — Jillian K Pierorazio
(74) *Attorney, Agent, or Firm* — Wolf, Greenfield & Sacks, P.C.

(57) ABSTRACT

Provided is a yarn box, a yarn stripping method, an electronic device and a storage media. The yarn box includes a support, a yarn stripping rod and a yarn receiving rod; where a first end of the yarn receiving rod is connected to the support, a first end of the yarn stripping rod is slidably connected to the support, the yarn stripping rod is configured to slide to a yarn stripping position corresponding to a first yarn receiving rod among the yarn receiving rod when multiple yarn spindles are sleeved outside the first yarn receiving rod and the number of yarn spindles of the first yarn receiving rod reaches a set condition, the yarn stripping rod is provided with multiple yarn strippers corresponding to the multiple yarn spindles one by one, and the yarn strippers are configured to strip fiber yarn on outer surfaces of the corresponding yarn spindles.

13 Claims, 4 Drawing Sheets

(51) Int. Cl.

| | |
|---|---|
| ***B65H 54/88*** | (2006.01) |
| ***B65H 63/02*** | (2006.01) |
| ***B65H 63/04*** | (2006.01) |
| ***B65H 63/06*** | (2006.01) |

(52) U.S. Cl.
CPC ..... *B65H 54/88* (2013.01); *B65H 63/02* (2013.01); *B65H 63/04* (2013.01); *B65H 63/062* (2013.01); *B65H 2553/42* (2013.01); *B65H 2557/61* (2013.01); *B65H 2557/64* (2013.01); *B65H 2701/31* (2013.01)

(56) References Cited

U.S. PATENT DOCUMENTS

| | | | | | |
|---|---|---|---|---|---|
| 4,058,264 | A | * | 11/1977 | Kawashima | B65H 54/34 242/165 |
| 4,069,983 | A | * | 1/1978 | Muramatsu | B65H 54/343 242/473.7 |
| 4,138,072 | A | * | 2/1979 | Aoyama | B65H 67/0411 242/473.4 |
| 4,165,585 | A | * | 8/1979 | Ishida | D01H 9/10 57/274 |
| 4,555,067 | A | * | 11/1985 | Angelucci | B65H 54/26 414/222.09 |
| 4,555,215 | A | * | 11/1985 | Raasch | B65H 67/065 414/331.11 |
| 4,597,539 | A | * | 7/1986 | Conrad | B65H 67/04 242/473.8 |
| 5,337,138 | A | * | 8/1994 | Inada | B65H 63/006 356/238.2 |
| 5,356,085 | A | * | 10/1994 | Kobayashi | B65H 65/005 242/475.8 |
| 5,495,990 | A | * | 3/1996 | Tamura | B65H 54/34 242/475.7 |
| 5,553,798 | A | * | 9/1996 | Kobayashi | B65H 67/086 242/475.8 |
| 6,092,268 | A | * | 7/2000 | Mack | B65H 63/086 28/292 |
| 2021/0130123 | A1 | * | 5/2021 | Kurtz | B65H 67/064 |
| 2023/0096921 | A1 | | 3/2023 | Wei et al. | |

FOREIGN PATENT DOCUMENTS

| | | | | |
|---|---|---|---|---|
| CN | 105821543 | A | | 8/2016 |
| CN | 205575258 | U | | 9/2016 |
| CN | 207877020 | U | | 9/2018 |
| CN | 109722720 | A | | 5/2019 |
| CN | 112079186 | A | | 12/2020 |
| CN | 112960480 | A | | 6/2021 |
| CN | 113264415 | A | | 8/2021 |
| CN | 113533358 | A | | 10/2021 |
| CN | 214446433 | U | | 10/2021 |
| CN | 113896030 | A | | 1/2022 |
| CN | 113899749 | A | | 1/2022 |
| CN | 218403096 | U | | 1/2023 |
| CN | 115676513 | A | | 2/2023 |
| CN | 116503370 | A | | 7/2023 |
| EP | 0156306 | A1 | | 10/1985 |
| JP | 07017668 | A | * | 1/1995 |
| JP | H07-017668 | A | | 1/1995 |
| JP | H07-257822 | A | | 10/1995 |
| JP | H10-273269 | A | | 10/1998 |

OTHER PUBLICATIONS

Chinese Office Action dated Sep. 11, 2025, in connection with Chinese Application No. 202311254021.1, with English translation thereof.

Japanese Decision to Grant proposed Mar. 26, 2025, in connection with Japanese Application No. 2024-100508, with English translation thereof.

Japanese Notice of Reasons for Refusal dated Jul. 10, 2024, in connection with Japanese Application No. 2024-100508, with English translation thereof.

Japanese Notice of Reasons for Refusal dated Oct. 8, 2024, in connection with Japanese Application No. 2024-100508, with English translation thereof.

Chinese Notice of Grant of Invention Patent Right dated Dec. 17, 2025, in connection with Chinse Application No. 202311254021.1, with English translation thereof.

* cited by examiner

YARN BOX, YARN STRIPPING METHOD, YARN STRIPPING APPARATUS, ELECTRONIC DEVICE AND STORAGE MEDIA

CROSS-REFERENCE TO RELATED APPLICATIONS

The present application claims priority to Chinese Patent Application No. CN202311254021.1, filed with the China National Intellectual Property Administration on Sep. 26, 2023, the disclosure of which is hereby incorporated herein by reference in its entirety.

TECHNICAL FIELD

The present disclosure relates to the field of mechanical and computer technologies. The present disclosure specifically relates to a yarn box, a yarn stripping method, a yarn stripping apparatus, an electronic device and a storage media.

BACKGROUND

In the production process of chemical fiber products, a winding machine is used to wind the fiber yarn to obtain a plurality of yarn spindles. These yarn spindles are moved from the winding machine to a yarn box through a doffer for temporary storage, to perform subsequent operations corresponding to the process flow. However, since the fiber yarn on these yarn spindles may have a length of yarn hanging down, the drooping fiber yarn of adjacent yarn spindles may become knotted or entangled in other machines or components during the movement. Moreover, when the fiber yarn is wound into a yarn spindle in the winding machine and the yarn spindle is almost fully wound, the quality of this layer of fiber yarn on the outer surface of the yarn spindle is poor due to the deceleration of the winding machine.

Therefore, in order to avoid this situation, the yarn stripping operation needs to be performed on the yarn spindle after the winding of the yarn spindle is completed.

SUMMARY

The present disclosure provides a yarn box, a yarn stripping method, a yarn stripping apparatus, an electronic device and a storage media.

According to an aspect of the present disclosure, provided is a yarn box, including:

a support;

at least one yarn receiving rod, where a first end of the yarn receiving rod is connected to the support, and a second end of the yarn receiving rod is configured to correspond to a discharge port of a doffer to enable a plurality of yarn spindles unloaded from the discharge port to be sleeved outside the yarn receiving rod; and a yarn stripping rod, where a first end of the yarn stripping rod is slidably connected to the support, the yarn stripping rod is configured to slide to a yarn stripping position corresponding to a first yarn receiving rod among the at least one yarn receiving rod when the plurality of yarn spindles are sleeved outside the first yarn receiving rod and the number of yarn spindles of the first yarn receiving rod reaches a set condition, the yarn stripping rod is provided with a plurality of yarn strippers corresponding to the plurality of yarn spindles one by one, and the yarn strippers are configured to strip fiber yarn on outer surfaces of the corresponding yarn spindles.

According to another aspect of the present disclosure, provided is a yarn stripping method, including:

controlling a discharge port of a doffer to correspond to a second end of a first yarn receiving rod in the yarn box according to any one of the embodiments of the present disclosure;

controlling the doffer to unload a plurality of yarn spindles from the discharge port so that the plurality of yarn spindles are sleeved outside the first yarn receiving rod;

controlling a yarn stripping rod in the yarn box to slide to a yarn stripping position corresponding to the first yarn receiving rod when the number of yarn spindles of the first yarn receiving rod reaches a set condition; and controlling yarn strippers on the yarn stripping rod to strip fiber yarn on outer surfaces of respective corresponding yarn spindles on the first yarn receiving rod.

According to yet another aspect of the present disclosure, provided is a yarn stripping apparatus, including:

a discharge position control module configured to control a discharge port of a doffer to correspond to a second end of a first yarn receiving rod in the yarn box according to any one of the embodiments of the present disclosure;

a discharge control module configured to control the doffer to unload a plurality of yarn spindles from the discharge port so that the plurality of yarn spindles are sleeved outside the first yarn receiving rod;

a sliding control module of yarn stripping rod configured to control a yarn stripping rod in the yarn box to slide to a yarn stripping position corresponding to the first yarn receiving rod when the number of yarn spindles of the first yarn receiving rod reaches a set condition; and a yarn stripper control module configured to control yarn strippers on the yarn stripping rod to strip fiber yarn on outer surfaces of respective corresponding yarn spindles.

According to yet another aspect of the present disclosure, provided is an electronic device, including:

at least one processor; and a memory connected in communication with the at least one processor;

where the memory stores an instruction executable by the at least one processor, and the instruction, when executed by the at least one processor, enables the at least one processor to execute the yarn stripping method according to any one of the embodiments of the present disclosure.

According to yet another aspect of the present disclosure, provided is a non-transitory computer-readable storage medium storing a computer instruction thereon, and the computer instruction is used to cause a computer to execute the yarn stripping method according to any one of the embodiments of the present disclosure.

According to yet another aspect of the present disclosure, provided is a computer program product including a computer program, and the computer program implements any point cloud model pre-training method, any point cloud model training method, any point cloud detection method or any point cloud segmentation method according to the embodiments of the present disclosure, when executed by a processor.

According to the technology of the present disclosure, one or more yarn receiving rods are provided in the yarn box, one end of the yarn receiving rod is connected to the support in the yarn box, and the other end is configured to correspond to the discharge port of the doffer to enable a plurality of yarn spindles unloaded from the discharge port to be sleeved in the yarn receiving rod. Thus, the yarn box can store a plurality of yarn spindles. At the same time, the yarn stripping rod with one end slidably connected to the support is provided in the yarn box, and the yarn stripping rod can slide to the yarn stripping position corresponding to the first yarn receiving rod among the one or more yarn receiving rods when the plurality of yarn spindles are sleeved in the first yarn receiving rod and the number of yarn spindles on the first yarn receiving rod reaches the set condition, so that the yarn strippers on the yarn stripping rod can strip the fiber yarn on the outer surfaces of respective corresponding yarn spindles. Therefore, the arrangement of the yarn stripping rod in the yarn box can be convenient to strip the fiber yarn hanging down from the yarn spindles in advance before the yarn spindles are stored or transferred, and can avoid the fiber yarn on the yarn spindles from enwinding other devices during subsequent storage or transfer.

It should be understood that the content described in this part is not intended to identify critical or essential features of embodiments of the present disclosure, nor is it used to limit the scope of the present disclosure. Other features of the present disclosure will be easily understood through the following description.

BRIEF DESCRIPTION OF THE DRAWINGS

The accompanying drawings are used to better understand the present solution, and do not constitute a limitation to the present disclosure.

DETAILED DESCRIPTION

Hereinafter, descriptions to exemplary embodiments of the present disclosure are made with reference to the accompanying drawings, include various details of the embodiments of the present disclosure to facilitate understanding, and should be considered as merely exemplary. Therefore, those having ordinary skill in the art should realize, various changes and modifications may be made to the embodiments described herein, without departing from the scope of the present disclosure. Likewise, for clarity and conciseness, descriptions of well-known functions and structures are omitted in the following descriptions.

Figure 1:
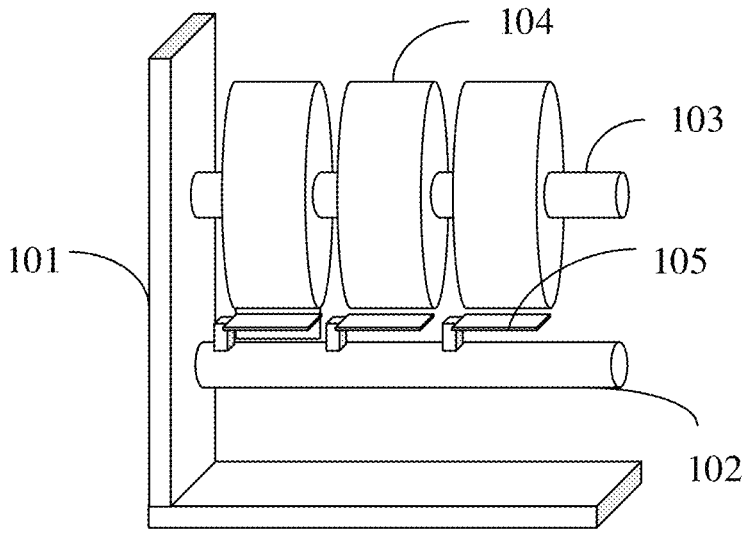
FIG. 1 is a structural diagram of a yarn box according to an embodiment of the present disclosure.

FIG. 1 is a structural diagram of a yarn box according to an embodiment of the present disclosure.

As shown in FIG. 1, the yarn box includes a support 101, a yarn stripping rod 102 and at least one yarn receiving rod 103. A first end of the yarn receiving rod 103 is connected to the support 101, and a second end of the yarn receiving rod 103 is configured to correspond to a discharge port of a doffer to enable a plurality of yarn spindles 104 unloaded from the discharge port to be sleeved outside the yarn receiving rod 103. A first end of the yarn stripping rod 102 is slidably connected to the support 101, the yarn stripping rod 102 is configured to slide to a yarn stripping position corresponding to a first yarn receiving rod 103 among the at least one yarn receiving rod 103 when the plurality of yarn spindles 104 are sleeved outside the first yarn receiving rod 103 and the number of yarn spindles 104 of the first yarn receiving rod 103 reaches a set condition, the yarn stripping rod 102 is provided with a plurality of yarn strippers 105 corresponding to the plurality of yarn spindles 104 one by one, and the yarn strippers 105 are configured to strip the fiber yarn on outer surfaces of the corresponding yarn spindles 104.

It can be understood that the doffer can move between the winding machine and the yarn box, the feed port of the doffer corresponds to the discharge port of the winding machine, and the doffer is configured to extract a plurality of yarn spindles 104 from the winding machine and move the plurality of yarn spindles 104 to the yarn box for storage.

It can be understood that the yarn spindle 104 is a roll of yarn formed by winding the fiber yarn on a hollow cylinder.

It can be understood that the fiber yarn on the outer surface of the yarn spindle 104 refer to a layer of fiber yarn on the outer surface of the yarn spindle, that is, the outermost layer of fiber yarn.

It can be understood that one or more yarn receiving rods 103 can be provided in the yarn box. For example, a plurality of yarn receiving rods 103 are arranged in multiple rows and columns parallel to each other. The support 101 stands on the ground, and the yarn receiving rod 103 is parallel to the ground, so that the second end of the yarn receiving rod 103 corresponds to the discharge port of the doffer.

It can be understood that the first yarn receiving rod 103 is the yarn receiving rod 103 that is feeding. When the yarn spindles 104 fed to the first yarn receiving rod 103 meet the set condition, the yarn spindles 104 on the first yarn receiving rod 103 start to be stripped.

It can be understood that the above set condition may be that the number of yarn spindles 104 reaches a set number threshold. For example, when the number of yarn spindles 104 is greater than 8, it is determined that the number of yarn spindles 104 reaches the set condition.

It can be understood that one or more yarn stripping rods 102 may be provided in the yarn box. Each yarn stripping rod 102 corresponds to one or more yarn receiving rods 103, to strip the fiber yarn on the outer surface (that is, the outermost layer of fiber yarn) of the yarn spindle 104 on the one or more yarn receiving rods 103. If one yarn stripping rod 102 corresponds to a plurality of yarn receiving rods 103, then: when a certain yarn receiving rod 103 has just finished feeding, the yarn stripping rod 102 can be slid to a position close to this yarn receiving rod 103, so that the yarn stripping rod 102 strips the fiber yarn on the outer surface of the yarn spindle 104 on the yarn receiving rod 103.

It can be understood that the support 101 is provided with a slide rail, the first end of the yarn stripping rod 102 is provided with a pulley, and the pulley is embedded in the slide rail and slides close to the first yarn receiving rod 103. The slide rail can also be provided with clamping blocks corresponding to the yarn receiving rod 103 respectively. When the yarn stripping rod 102 slides to the yarn stripping position corresponding to the first yarn receiving rod 103, the clamping block corresponding to the yarn stripping position can extend into the slide rail to clamp the yarn stripping rod 102, so as to fix the yarn stripping rod 102.

According to the above embodiment, one or more yarn receiving rods 103 are provided in the yarn box, one end of the yarn receiving rod 103 is connected to the support 101 in the yarn box, and the other end is configured to correspond to the discharge port of the doffer to enable a plurality of yarn spindles 104 unloaded from the discharge port to be sleeved in the yarn receiving rod 103. Thus, the yarn box can store a plurality of yarn spindles 104. At the same time, the yarn stripping rod 102 with one end slidably connected to the support 101 is provided in the yarn box, and the yarn stripping rod 102 can slide to the yarn stripping position corresponding to the first yarn receiving rod 103 among the one or more yarn receiving rods 103 when the plurality of yarn spindles 104 are sleeved in the first yarn receiving rod 103 and the number of yarn spindles 104 on the first yarn receiving rod 103 reaches the set condition, so that the yarn strippers 105 on the yarn stripping rod 102 can strip the fiber yarn on the outer surfaces of respective corresponding yarn spindles 104. Therefore, the arrangement of the yarn stripping rod 102 in the yarn box can be convenient to strip the outermost layer of fiber yarn on the yarn spindle 104 in advance before the yarn spindle 104 is stored or transferred, and can not only avoid the fiber yarn from enwinding other devices due to the outermost layer of loose fiber yarn or the drooping yarn head on the yarn spindle 104 during subsequent storage or transfer, but also complete the yarn stripping process efficiently under better working conditions, improving the production efficiency.

Figure 2:
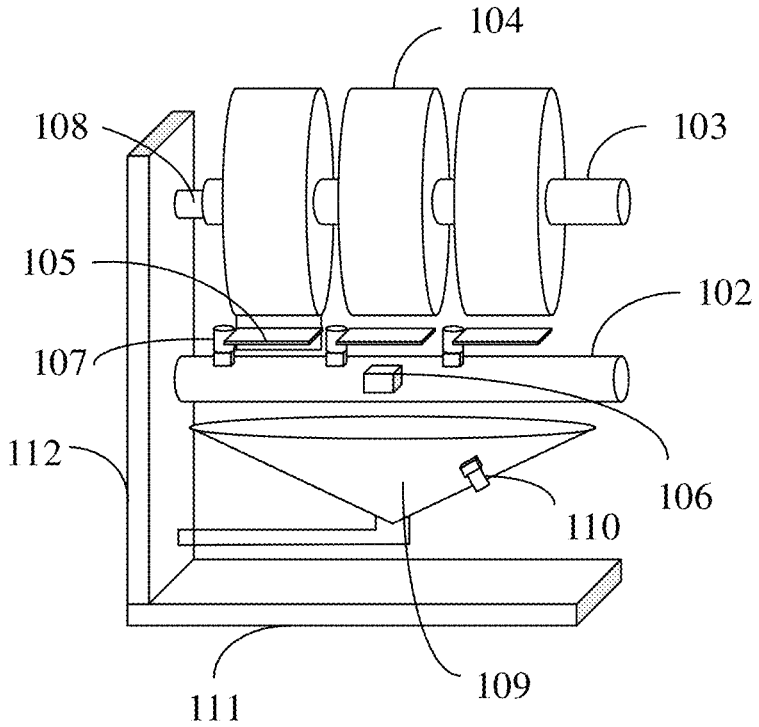
FIG. 2 is a structural diagram of a yarn box according to another embodiment of the present disclosure.

FIG. 2 is a structural diagram of a yarn box according to another embodiment of the present disclosure.

In an embodiment, as shown in FIG. 2, the yarn stripping rod 102 is further provided with a camera 106. The camera 106 is configured to photograph the plurality of yarn spindles 104 sleeved outside the first yarn receiving rod 103, to obtain a yarn spindle image for determining a target yarn spindle 104 with drooping fiber yarn among the plurality of yarn spindles 104. The yarn stripper 105 is telescopically connected to the yarn stripping rod 102, and configured to extend from the yarn stripping rod 102 towards the target yarn spindle 104 when a corresponding yarn spindle 104 is the target yarn spindle 104, to strip the fiber yarn on an outer surface of the target yarn spindle 104.

It can be understood that the yarn stripping rod 102 may be provided with one or more cameras 106 to photograph all the yarn spindles 104 on the yarn receiving rod 103 from various angles.

It can be understood that the camera 106 provides the image of the yarn spindle 104 to the background service, and the background service determines the target yarn spindle 104 with drooping fiber yarn based on the image of the yarn spindle 104. For example, the background service can use an image recognition model to recognize the image, to determine the target yarn spindle.

It can be understood that the drooping fiber yarn refers to the fiber yarn which hangs down from the side of the yarn spindle 104 and of which the end is suspended in the air and does not contact the side of the yarn spindle 104.

It can be understood that there may be one or more target yarn spindles 104.

It can be understood that when there are a plurality of target yarn spindles 104, the yarn strippers 105 corresponding to the target yarn spindles 104 respectively extend from the yarn stripping rod 102 towards the target yarn spindles 104.

It can be understood that the yarn stripper 105 is vertically connected to the yarn stripping rod 102 through a telescopic rod 107. When yarn stripping is required, the telescopic rod 107 is extended to move the yarn stripper 105 close to the target yarn spindle 104. After the yarn stripper 105 strips the fiber yarn on the outer surface, the telescopic rod 107 retracts to move the yarn stripper 105 away from the target yarn spindle 104.

According to the above embodiment, the camera 106 is used to photograph the plurality of yarn spindles 104 on the first yarn receiving rod 103, and the target yarn spindle 104 with drooping fiber yarn can be accurately recognized through visual recognition. The retractable yarn stripper 105 is provided in the yarn stripping rod 102, to facilitate stripping the fiber yarn on the outer surface of the target yarn spindle 104 and improve the stripping efficiency of the fiber yarn. For the target yarn spindle with drooping fiber yarn, the quality of this layer of fiber yarn on the outer surface is also poor. Therefore, stripping the fiber yarn on the outer surface of the target yarn spindle can not only strip the drooping fiber yarn of the yarn spindle to avoid the fiber yarn from enwinding other devices, but also improve the quality of the fiber yarn of the yarn spindle. For other spindles with no drooping fiber yarn, the fiber yarn on the outer surfaces may not be stripped to improve the stripping efficiency for the yarn spindles in the yarn box.

In an implementation, the first end of each yarn receiving rod 103 is rotatably connected to the support 101, and the yarn spindle image captured by the camera 106 is also used to identify the direction in which the fiber yarn of the plurality of yarn spindles sleeved on the first yarn receiving rod 103 is wound into spindles, that is, the first direction. The first yarn receiving rod 103 is configured to rotate in an opposite direction of the first direction to rotate a yarn spindle 104 sleeved outside the first yarn receiving rod 103 and make the fiber yarn wound on the yarn spindle 104 hang down before determining the target yarn spindle with drooping fiber yarn among the plurality of yarn spindles.

It can be understood that the yarn receiving rod 103 can be connected to the support 101 through a rotating shaft 108, and can rotate clockwise or counterclockwise.

It can be understood that the first yarn receiving rod 103 is firstly rotated before determining which yarn spindles on the first yarn receiving rod are the target yarn spindles 104. The direction of rotation is opposite to the direction in which the fiber yarn of the yarn spindles 104 is wound into spindles, so that the fiber yarn wound on the yarn spindles 104 can hang down, that is, the end of the fiber yarn is suspended.

According to the above implementation, before identifying the target yarn spindle, the first yarn receiving rod 103 is rotated in advance to rotate the yarn spindle 104 and make the fiber yarn wound on the yarn spindle 104 hang down, In this way, for a yarn spindle 104 that currently has no drooping fiber yarn but may have drooping fiber yarn in the future, the end of the fiber yarn is drooped as much as possible, and this yarn spindle is determined as the target yarn spindle, so that the quality of the fiber yarn of the yarn spindle can be improved subsequently by stripping the fiber yarn on the outer surface. On the other hand, the possibility of the yarn spindle 104 in the yarn box being hooked or entangled with other components during the subsequent transfer process can be further reduced.

In an implementation, the yarn stripper 105 may include a yarn adsorption device and a yarn cutting knife. The yarn adsorption device is configured to adsorb an end of the drooping fiber yarn of the target yarn spindle when the yarn stripper 105 extends from the yarn stripping rod 102 towards the target yarn spindle so that the end is fixed on the yarn adsorption device, and drive the target yarn spindle to rotate in the opposite direction to the first direction so that the fiber yarn on the outer surface of the target yarn spindle is rolled out. The yarn cutting knife is configured to cut the fiber yarn connected between the yarn adsorption device and the target yarn spindle when the adsorption time of the yarn adsorption device reaches a set threshold.

It can be understood that the yarn adsorption device is rotatably connected to the yarn stripper 105. The yarn adsorption device rotates in the opposite direction of the first direction while adsorbing the end of the drooping fiber yarn of the target yarn spindle, so that the fiber yarn on the target yarn spindle is rolled out and rolled into the yarn adsorption device.

It can be understood that the yarn cutting knife is retractably and slidably connected to the yarn stripper. When the adsorption time of the yarn adsorption device reaches the set threshold, the yarn cutting knife moves and approaches the fiber yarn that is connected to the yarn adsorption device and the target yarn spindle to cut the fiber yarn.

It can be understood that, when the adsorption time of the yarn adsorption device reaches the set threshold, it can be considered that the fiber yarn on the outer surface of the target yarn spindle has been completely rolled out.

According to the above implementation, the end of the drooping fiber yarn of the target yarn spindle is fixed on the yarn adsorption device through the yarn adsorption device, and then the yarn adsorption device drives the target yarn spindle to rotate in the opposite direction of the first direction, so that the fiber yarn on the outer surface of the target yarn spindle can be rolled out. When the adsorption time of the yarn adsorption device reaches the set threshold, the yarn cutting knife moves and approaches the fiber yarn that is connected to the yarn adsorption device and the target yarn spindle to cut the fiber yarn, thereby achieving the effect of stripping the fiber yarn on the outer surface of the yarn spindle by the yarn stripper.

In an implementation, the first yarn receiving rod 103 is further configured to, when the yarn adsorption device adsorbs the fiber yarn on the outer surface of the target yarn spindle, rotate in the opposite direction to the first direction to rotate the target yarn spindle so that the fiber yarn on the outer surface of the target yarn spindle is rolled out.

In this example, the first yarn receiving rod is controlled to rotate in the direction opposite to the direction in which the fiber yarn of the target yarn spindle is wound into spindle while the yarn stripper performs yarn stripping on the target yarn spindle, which can speed up the rotation of the target yarn spindle in the opposite direction, and thus accelerate the speed at which the fiber yarn on the outer surface of the target yarn spindle is rolled out, thereby improving the stripping efficiency of the yarn stripper.

In an implementation, the yarn stripper 105 is slidably connected to the yarn stripping rod 102, and the yarn stripper 105 is configured to, when the corresponding yarn spindle 104 is the target yarn spindle 104, slide on the yarn stripping rod 102 to calibrate corresponding positions of the yarn stripper 105 and the target yarn spindle 104.

It can be understood that the yarn stripping rod 102 may be cylindrical. The yarn stripper 105 is connected to the yarn stripping rod 102 through a telescopic rod. The first end of the telescopic rod is an elastic clamping groove, which clamps the yarn stripping rod 102. The second end of the telescopic rod is connected to the yarn stripper 105. When the yarn stripper 105 needs to slide to calibrate its corresponding position relative to the target yarn spindle 104, the clamping groove can be loosened so that the clamping groove can slide in the extension direction of the yarn stripping rod 102. When the yarn stripper 105 has completed the position calibration relative to the target yarn spindle 104, the clamping groove can be tightened to fix the position of the yarn stripper 105 on the yarn stripping rod 102, to facilitate the yarn stripper 105 to strip the fiber yarn on the outer surface of the target yarn spindle 104.

According to the above implementation, by arranging the yarn stripper 105 to be slidably connected to the yarn stripping rod 102, the yarn stripper 105 can slide on the yarn stripping rod 102 before the yarn stripper 105 is used to perform yarn stripping on the target yarn spindle 104, thereby calibrating the yarn stripping positions of the yarn stripper 105 and the target yarn spindle 104, and improving the yarn stripping efficiency.

In an implementation, as shown in FIG. 2, the yarn box may further include a waste yarn container 109 located below the yarn stripping rod 102, having a container opening facing the yarn stripping rod 102, and configured to collect the fiber yarn stripped by the yarn stripper 105.

It can be understood that the container opening is close to the yarn spindle 104 on the first yarn receiving rod 103.

It can be understood that the orthographic projection of the container opening on the ground covers the orthographic projection of the yarn spindle 104 of the first yarn receiving rod 103 on the ground.

It can be understood that the container opening may be in the shape of a funnel opening or a bag opening, etc.

According to the above implementation, using the waste yarn container to collect the stripped fiber yarn can ensure that the yarn box is clean, and avoid the fiber yarn from falling everywhere.

In an implementation, as shown in FIG. 2, the yarn box further includes a vacuum adsorber (not shown in the figure) with a suction nozzle 110 disposed on an inner side of the waste yarn container and close to the container opening, where the vacuum adsorber is configured to adsorb the fiber yarn stripped by the yarn stripper 105, to collect the stripped fiber yarn in the waste yarn container.

It can be understood that the vacuum absorber and the waste yarn container can be integrated.

According to the above implementation, using the vacuum absorber to absorb the fiber yarn stripped by the yarn stripper 105 can control the stripped fiber yarn to be accurately collected in the waste yarn container, and avoid the stripped fiber yarn from falling outside the waste yarn container.

In an implementation, as shown in FIGS. 1 and 2, the support 101 in the yarn box may include a bottom plate 111 and a support plate 112 perpendicular to the bottom plate 111, the first end of the yarn receiving rod 103 is connected to the support plate 112 and parallel to the bottom plate 111, and the first end of the yarn stripping rod 102 is slidably connected to the support plate 112 and parallel to the bottom plate 111.

According to the above implementation, the support 101 includes the bottom plate 111 and the support plate 112 perpendicular to the bottom plate 111, the yarn receiving rod 103 is connected to the support plate 112 and parallel to the bottom plate 111, and the yarn stripping rod 102 is connected to the support plate 112 and parallel to the bottom plate 111. Thus, when a large number of yarn spindles 104 are stored in the yarn box, the balance of the yarn box can be maintained, and the yarn box will not fall due to the deviation of the center of gravity. On the other hand, the yarn receiving rod 103 is parallel to the bottom plate 111, thus facilitating the connection between the yarn receiving rod 103 and the doffer, so as to unload the yarn spindles 104.

Figure 3:
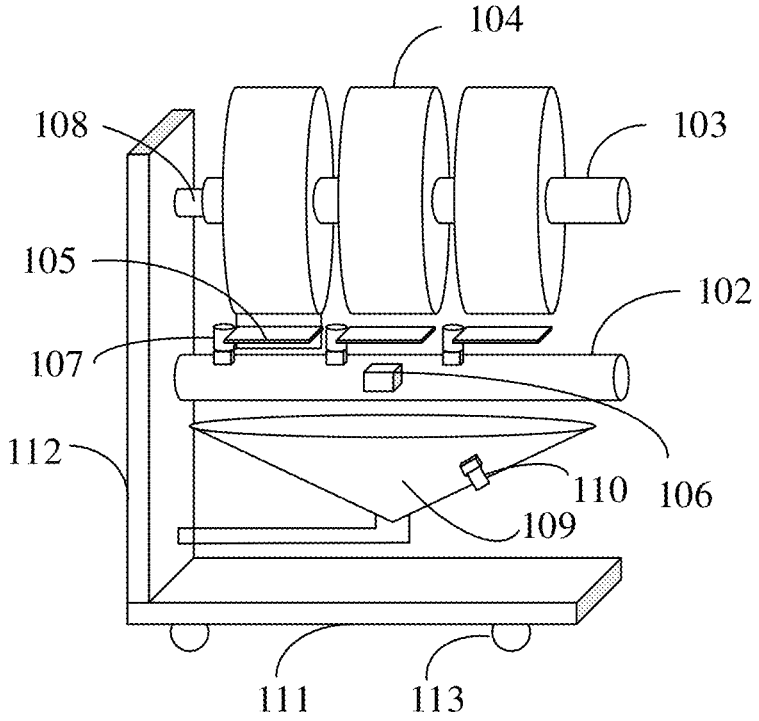
FIG. 3 is a structural diagram of a yarn box according to another embodiment of the present disclosure.

FIG. 3 is a structural diagram of a yarn box according to another embodiment of the present disclosure.

In an embodiment, as shown in FIG. 3, a plurality of pulleys are provided on a bottom plane of the bottom plate away from the support plate.

According to the above embodiment, a plurality of pulleys 113 are provided on the bottom plane of the bottom plate 111 of the yarn box, facilitating the movement of the yarn box to transfer the yarn spindles 104.

Figure 4:
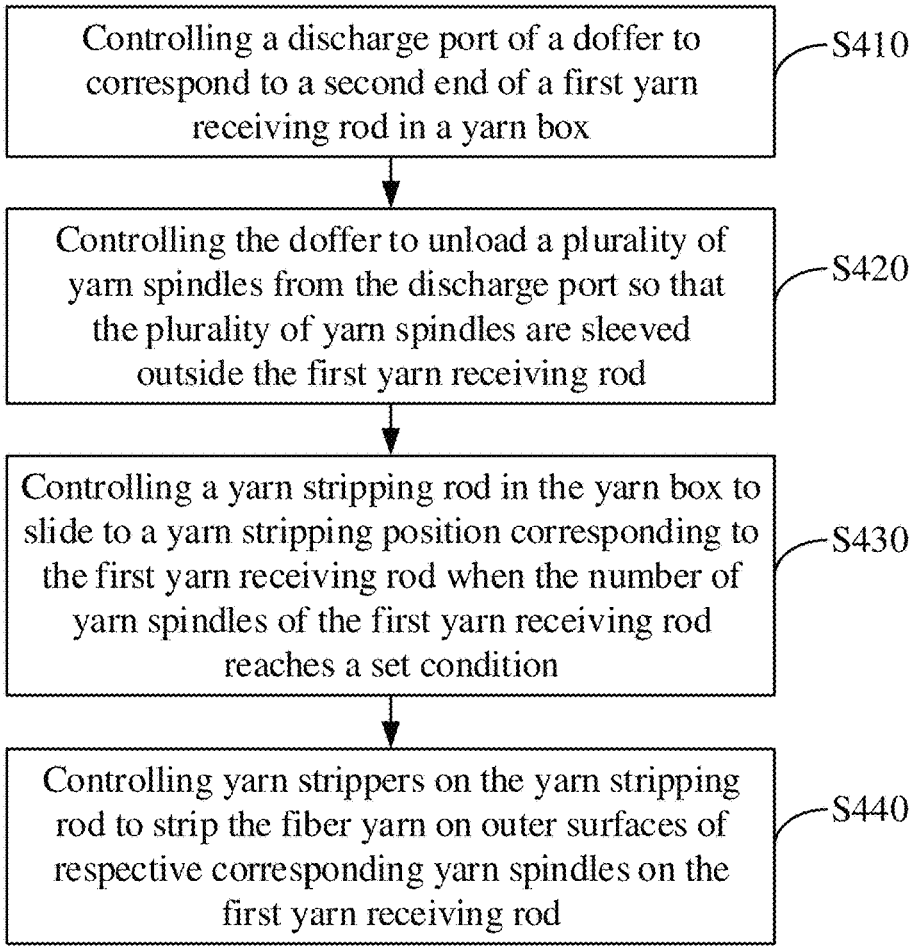
FIG. 4 is a flow chart of a yarn stripping method according to an embodiment of the present disclosure.

FIG. 4 is a flow chart of a yarn stripping method according to an embodiment of the present disclosure.

As shown in FIG. 4, the yarn stripping method may include:

S410: controlling a discharge port of a doffer to correspond to a second end of a first yarn receiving rod in a yarn box, where the yarn box is the yarn box described in any one of the embodiments of the present disclosure;

S420: controlling the doffer to unload a plurality of yarn spindles from the discharge port so that the plurality of yarn spindles are sleeved outside the first yarn receiving rod;

S430: controlling a yarn stripping rod in the yarn box to slide to a yarn stripping position corresponding to the first yarn receiving rod when the number of yarn spindles of the first yarn receiving rod reaches a set condition; and

S440: controlling yarn strippers on the yarn stripping rod to strip the fiber yarn on outer surfaces of respective corresponding yarn spindles on the first yarn receiving rod.

Here, the structure and function of the yarn box can refer to any one of the foregoing embodiments and will not be described in detail here.

It can be understood that the discharge port of the doffer corresponds to the second end of the first yarn receiving rod in the yarn box, meaning that the discharge port is aligned with the second end.

It can be understood that the above set condition may be that the number of yarn spindles reaches a set number threshold. For example, when the number of yarn spindles is greater than 8, it is determined that the number of yarn spindles reaches the set condition.

It can be understood that one or more yarn strippers on the yarn stripping rod are controlled to strip the fiber yarn on the outer surfaces of the respective corresponding yarn spindles on the first yarn receiving rod.

It can be understood that the yarn stripping rod in the yarn box slides to the yarn stripping position corresponding to the first yarn receiving rod, meaning that the yarn stripping rod slides to a position parallel and close to the first yarn receiving rod, so that the yarn strippers on the yarn stripping rod strip the fiber yarn on the outer surfaces of the yarn spindles on the first yarn receiving rod.

According to the above implementation, the discharge port of the doffer is controlled to correspond to the first yarn receiving rod in the yarn box, and then the doffer is controlled to unload a plurality of yarn spindles from the discharge port, so that the plurality of yarn spindles can be sleeved outside the first yarn receiving rod. Thus, a plurality of yarn spindles can be stored in the yarn box. When the number of yarn spindles of the first yarn receiving rod reaches the set condition, the yarn stripping rod in the yarn box is controlled to slide to the yarn stripping position corresponding to the first yarn receiving rod, and then the yarn strippers on the yarn stripping rod are used to strip the fiber yarn on the outer surfaces of the corresponding yarn spindles on the first yarn receiving rod.

In an implementation, a camera is further provided on the yarn stripping rod, and the yarn strippers are telescopically connected to the yarn stripping rod. The above-mentioned step of controlling yarn strippers on the yarn stripping rod to strip the fiber yarn on outer surfaces of respective corresponding yarn spindles on the first yarn receiving rod, may include: photographing the plurality of yarn spindles sleeved outside the first yarn receiving rod to obtain a first yarn spindle image; determining a target yarn spindle with drooping fiber yarn among the plurality of yarn spindles according to the first yarn spindle image; controlling a yarn stripper corresponding to the target yarn spindle to extend from the yarn stripping rod towards the target yarn spindle; and controlling the yarn stripper corresponding to the target yarn spindle to strip the fiber yarn on an outer surface of the target yarn spindle.

It can be understood that the yarn stripping rod may be provided with one or more cameras to photograph all the yarn spindles on the yarn receiving rod from various angles.

It can be understood that there may be one or more target yarn spindles.

It can be understood that when there are a plurality of target yarn spindles, the yarn strippers corresponding to the target yarn spindles respectively extend from the yarn stripping rod towards the target yarn spindles.

It can be understood that the yarn stripper is vertically connected to the yarn stripping rod through a telescopic rod. When yarn stripping is required, the telescopic rod is extended to move the yarn stripper close to the target yarn spindle. After the yarn stripper strips the fiber yarn on the outer surface, the telescopic rod retracts to move the yarn stripper away from the target yarn spindle.

According to the above implementation, the camera is used to photograph the plurality of yarn spindles on the first yarn receiving rod, and the target yarn spindle with drooping fiber yarn can be accurately recognized through visual recognition. The retractable yarn stripper is provided in the yarn stripping rod, to facilitate stripping the fiber yarn on the outer surface of the target yarn spindle and improve the stripping efficiency of the fiber yarn. For the target yarn spindle with drooping fiber yarn, the quality of this layer of fiber yarn on the outer surface is also poor. Therefore, stripping the fiber yarn on the outer surface of the target yarn spindle can not only strip the drooping fiber yarn of the yarn spindle to avoid the fiber yarn from enwinding other devices, but also improve the quality of the fiber yarn of the yarn spindle. For other spindles with no drooping fiber yarn, the fiber yarn on the outer surfaces may not be stripped to improve the stripping efficiency for the yarn spindles in the yarn box.

In an implementation, the yarn strippers are slidably connected to the yarn stripping rod, and the above method may further include: before controlling the yarn stripper corresponding to the target yarn spindle to extend from the yarn stripping rod, controlling the yarn stripper corresponding to the target yarn spindle to slide on the yarn stripping rod to calibrate corresponding positions of the yarn stripper and the target yarn spindle.

It can be understood that the yarn receiving rod can be connected to the support through a rotating shaft, and can rotate clockwise or counterclockwise.

It can be understood that the first yarn receiving rod is firstly rotated when the number of yarn spindles of the first yarn receiving rod reaches the set condition, that is, before starting to prepare to perform yarn stripping on the yarn spindles of the first yarn receiving rod. The direction of rotation is opposite to the direction in which the fiber yarn of the yarn spindles is wound, so that the fiber yarn wound on the yarn spindles can hang down, that is, the end of the fiber yarn is suspended.

According to the above implementation, before stripping the fiber yarn on the outer surface of the yarn spindle on the first yarn receiving rod, the first yarn receiving rod is rotated in advance to rotate the yarn spindle and make the fiber yarn wound on the yarn spindle hang down, In this way, for a yarn spindle that currently has no drooping fiber yarn but may have drooping fiber yarn in the future, the end of the fiber yarn is drooped as much as possible, so that the drooping fiber yarn can be stripped subsequently by stripping the fiber yarn on the outer surface, thereby further reducing the possibility of the yarn spindle being hooked or entangled with other components during the subsequent transfer process.

In an implementation, the above step of determining a target yarn spindle with drooping fiber yarn among the plurality of yarn spindles according to the first yarn spindle image, includes: inputting the first yarn spindle image into an image recognition model to obtain a first detection frame image output by the image recognition model, where the first detection frame image includes the first yarn spindle image and at least one detection frame including any drooping fiber yarn in the first yarn spindle image; and determining the target yarn spindle among the plurality of yarn spindles based on the position information of each detection frame in the first detection frame image.

It can be understood that the above image recognition model may be a pre-trained model.

It can be understood that the first detection frame image may include one or more detection frames, and each detection frame may include an end of one drooping fiber yarn. The detection frames include different drooping fiber yarn.

It can be understood that the position information of each detection frame can be used to determine the yarn spindle corresponding to each detection frame, so as to determine the target yarn spindle.

According to the above implementation, using the image recognition model to recognize the drooping fiber yarn in the yarn spindle image can improve the accuracy in recognizing the drooping fiber yarn.

In an implementation, the above method may further include: obtaining a second yarn spindle image and a third yarn spindle image, where the second yarn spindle image and the third yarn spindle image are obtained by shooting all yarn spindles on the same yarn receiving rod from two different shooting angles; inputting the second yarn spindle image into the image recognition model to obtain a second detection frame image output by the image recognition model, where the second detection frame image includes the second yarn spindle image and at least one detection frame including any drooping fiber yarn in the second yarn spindle image; inputting the third yarn spindle image into the image recognition model to obtain a third detection frame image output by the image recognition model, where the third detection frame image includes the third yarn spindle image and at least one detection frame including any drooping fiber yarn in the third yarn spindle image; determining a first loss function based on position information of each detection frame in the second detection frame image and position information of each detection frame in the third detection frame image; and adjusting a model parameter of the image recognition model based on the first loss function.

It can be understood that the training process of the image recognition model can be the same as above, but the image recognition model is just pre-trained.

It can be understood that each first yarn spindle with drooping fiber yarn is determined based on the position information of each detection frame in the second detection frame image, each second yarn spindle with drooping fiber yarn is determined based on the position information of each detection frame in the third detection frame image, and the first loss function is determined based on the matching degree of each first yarn spindle and each second yarn spindle. The gradient information of the first loss function is used to adjust the model parameter of the image recognition model.

It can be understood that the second yarn spindle image and the third yarn spindle image are updated, the above steps are repeatedly performed, and the parameter adjustment of the image recognition model is stopped when the loss value of the first loss function reaches a set threshold.

According to the above implementation, there is no need to annotate the yarn spindle images, the adversarial learning is performed on the two images obtained by shooting all the yarn spindles on the same yarn receiving rod from two different angles, and the learning result is used to adjust the model parameter of the image recognition model, which can not only improve the efficiency of model training, but also improve the model accuracy.

In an implementation, the first end of the yarn receiving rod is rotatably connected to a support rod in the yarn box, and the method may further include: identifying a first direction in which the fiber yarn of the plurality of yarn spindles is wound into spindles according to the first yarn spindle image; and rotating in an opposite direction of the first direction to rotate a yarn spindle sleeved outside the first yarn receiving rod and make the fiber yarn wound on the yarn spindle hang down before determining the target yarn spindle with drooping fiber yarn among the plurality of yarn spindles.

It can be understood that the yarn receiving rod can be connected to the support through a rotating shaft, and can rotate clockwise or counterclockwise.

It can be understood that the first yarn receiving rod is firstly rotated before determining which yarn spindles on the first yarn receiving rod are the target yarn spindles. The direction of rotation is opposite to the direction in which the fiber yarn of the yarn spindles is wound into spindles, so that the fiber yarn wound on the yarn spindles can hang down, that is, the end of the fiber yarn is suspended.

According to the above implementation, before determining the target yarn spindle, the first yarn receiving rod is rotated in advance to rotate the yarn spindle and make the fiber yarn wound on the yarn spindle hang down, In this way, a yarn spindle that currently has no drooping fiber yarn but may have drooping fiber yarn in the future may be determined as the target yarn spindle, so that the quality of the fiber yarn of the yarn spindle can be improved subsequently by stripping the fiber yarn on the outer surface. On the other hand, the possibility of the yarn spindle being hooked or entangled with other components during the subsequent transfer process can be further reduced.

In an implementation, the yarn stripper includes a yarn adsorption device and a yarn cutting knife, and the step of controlling the yarn stripper corresponding to the target yarn spindle to strip fiber yarn on an outer surface of the target yarn spindle, includes: controlling the yarn adsorption device to adsorb an end of the drooping fiber yarn of the target yarn spindle so that the end is fixed on the yarn adsorption device, and controlling the yarn adsorption device to drive the target yarn spindle to rotate in the opposite direction to the first direction so that the fiber yarn on the outer surface of the target yarn spindle is rolled out; and controlling the yarn cutting knife to cut the fiber yarn connected between the yarn adsorption device and the target yarn spindle when the adsorption time of the yarn adsorption device reaches a set threshold.

It can be understood that the yarn adsorption device is rotatably connected to the yarn stripper. The yarn adsorption device rotates in the opposite direction of the first direction while adsorbing the end of the drooping fiber yarn of the target yarn spindle, so that the fiber yarn on the target yarn spindle is rolled out and rolled into the yarn adsorption device.

It can be understood that the yarn cutting knife is retractably and slidably connected to the yarn stripper. When the adsorption time of the yarn adsorption device reaches the set threshold, the yarn cutting knife moves and approaches the fiber yarn that is connected to the yarn adsorption device and the target yarn spindle to cut the fiber yarn.

It can be understood that, when the adsorption time of the yarn adsorption device reaches the set threshold, it can be considered that the fiber yarn on the outer surface of the target yarn spindle has been completely rolled out.

According to the above implementation, the end of the drooping fiber yarn of the target yarn spindle is fixed on the yarn adsorption device through the yarn adsorption device, and then the yarn adsorption device drives the target yarn spindle to rotate in the opposite direction of the first direction, so that the fiber yarn on the outer surface of the target yarn spindle can be rolled out. When the adsorption time of the yarn adsorption device reaches the set threshold, the yarn cutting knife moves and approaches the fiber yarn that is connected to the yarn adsorption device and the target yarn spindle to cut the fiber yarn, thereby achieving the effect of stripping the fiber yarn on the outer surface of the yarn spindle by the yarn stripper.

In an implementation, the above method may further include: when the yarn adsorption device adsorbs the fiber yarn on the outer surface of the target yarn spindle, controlling the first yarn receiving rod to rotate in the opposite direction to the first direction to rotate the target yarn spindle so that the fiber yarn on the outer surface of the target yarn spindle is rolled out.

In this example, the first yarn receiving rod is controlled to rotate in the direction opposite to the direction in which the fiber yarn of the target yarn spindle is wound into spindle while the yarn stripper performs yarn stripping on the target yarn spindle, which can speed up the rotation of the target yarn spindle in the opposite direction, and thus accelerate the speed at which the fiber yarn on the outer surface of the target yarn spindle is rolled out, thereby improving the stripping efficiency of the yarn stripper.

In an implementation, the yarn box further includes a waste yarn container located below the yarn stripping rod and having a container opening facing the yarn stripping rod, and a vacuum adsorber with a suction nozzle disposed on an inner side of the waste yarn container and close to the container opening; and the above method further includes: controlling the vacuum adsorber to adsorb the fiber yarn stripped by the yarn stripper, to collect the stripped fiber yarn in the waste yarn container.

It can be understood that the container opening is close to the yarn spindle on the first yarn receiving rod.

It can be understood that the orthographic projection of the container opening on the ground covers the orthographic projection of the yarn spindle of the first yarn receiving rod on the ground.

It can be understood that the container opening may be in the shape of a funnel opening or a bag opening, etc.

According to the above implementation, using the waste yarn container to collect the stripped fiber yarn can ensure that the yarn box is clean, and avoid the fiber yarn from falling everywhere.

It can be understood that the vacuum absorber and the waste yarn container can be integrated.

According to the above implementation, using the waste yarn container to collect the stripped fiber yarn can ensure that the yarn box is clean, and avoid the fiber yarn from falling everywhere. Using the vacuum absorber to absorb the fiber yarn stripped by the yarn stripper can control the stripped fiber yarn to be accurately collected in the waste yarn container, and avoid the stripped fiber yarn from falling outside the waste yarn container.

Figure 5:
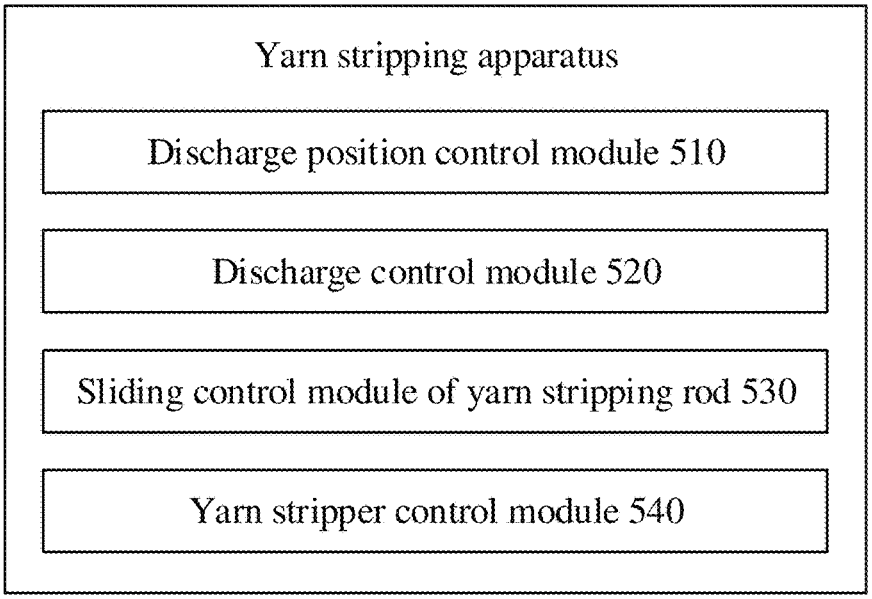
FIG. 5 is a structural block diagram of a yarn stripping apparatus according to an embodiment of the present disclosure.

FIG. 5 is a structural diagram of a yarn stripping apparatus according to an embodiment of the present disclosure.

As shown in FIG. 5, the yarn stripping apparatus may include:

a discharge position control module 510 configured to control a discharge port of a doffer to correspond to a second end of a first yarn receiving rod in the yarn box according to the embodiment of the present disclosure;

a discharge control module 520 configured to control the doffer to unload a plurality of yarn spindles from the discharge port so that the plurality of yarn spindles are sleeved outside the first yarn receiving rod;

a sliding control module of yarn stripping rod 530 configured to control a yarn stripping rod in the yarn box to slide to a yarn stripping position corresponding to the first yarn receiving rod when the number of yarn spindles of the first yarn receiving rod reaches a set condition; and a yarn stripper control module 540 configured to control yarn strippers on the yarn stripping rod to strip fiber yarn on outer surfaces of respective corresponding yarn spindles.

In an implementation, a camera is further provided on the yarn stripping rod, and the yarn strippers are telescopically connected to the yarn stripping rod; and the yarn stripper control module 540 includes:

a yarn spindle photographing unit configured to photograph the plurality of yarn spindles sleeved outside the first yarn receiving rod to obtain a first yarn spindle image;

an image recognition unit configured to determine a target yarn spindle with drooping fiber yarn among the plurality of yarn spindles according to the first yarn spindle image;

a first control unit configured to control a yarn stripper corresponding to the target yarn spindle to extend from the yarn stripping rod towards the target yarn spindle; and a second control unit configured to control the yarn stripper corresponding to the target yarn spindle to strip fiber yarn on an outer surface of the target yarn spindle.

In an implementation, the yarn strippers are slidably connected to the yarn stripping rod, and the apparatus further includes:

a position calibration module configured to, before controlling the yarn stripper corresponding to the target yarn spindle to extend from the yarn stripping rod, control the yarn stripper corresponding to the target yarn spindle to slide on the yarn stripping rod to calibrate corresponding positions of the yarn stripper and the target yarn spindle.

In an implementation, the image recognition unit is specifically configured to:

input the first yarn spindle image into an image recognition model to obtain a first detection frame image output by the image recognition model, where the first detection frame image includes the first yarn spindle image and at least one detection frame including any drooping fiber yarn in the first yarn spindle image; and determine the target yarn spindle among the plurality of yarn spindles based on position information of each detection frame in the first detection frame image.

In an implementation, the apparatus further includes:

an image obtaining module configured to obtain a second yarn spindle image and a third yarn spindle image, where the second yarn spindle image and the third yarn spindle image are obtained by shooting all yarn spindles on the same yarn receiving rod from two different shooting angles;

a first image recognition module configured to input the second yarn spindle image into the image recognition model to obtain a second detection frame image output by the image recognition model, where the second detection frame image includes the second yarn spindle image and at least one detection frame including any drooping fiber yarn in the second yarn spindle image;

a second image recognition module configured to input the third yarn spindle image into the image recognition model to obtain a third detection frame image output by the image recognition model, where the third detection frame image includes the third yarn spindle image and at least one detection frame including any drooping fiber yarn in the third yarn spindle image;

a loss function determining module configured to determine a first loss function based on position information of each detection frame in the second detection frame image and position information of each detection frame in the third detection frame image; and a model adjustment module configured to adjust a model parameter of the image recognition model based on the first loss function.

In an implementation, a first end of the yarn receiving rod is rotatably connected to a support rod in the yarn box, and the apparatus further includes:

a yarn receiving rod rotation module configured to, when the number of yarn spindles of the first yarn receiving rod reaches a set threshold, control the rotation of the first yarn receiving rod, to rotate a yarn spindle sleeved outside the first yarn receiving rod and make the fiber yarn wound on the yarn spindle hang down.

In an implementation, the yarn box further includes a waste yarn container located below the yarn stripping rod and having a container opening facing the yarn stripping rod, and a vacuum adsorber with a suction nozzle disposed on an inner side of the waste yarn container and close to the container opening; and the apparatus further includes:

an adsorption control module configured to control the vacuum adsorber to adsorb the fiber yarn stripped by the yarn stripper, to collect the stripped fiber yarn in the waste yarn container.

For the description of specific functions and examples of the modules and sub-modules of the apparatus of the embodiment of the present disclosure, reference may be made to the relevant description of the corresponding steps in the above-mentioned method embodiments, and details are not repeated here.

In the technical solution of the present disclosure, the acquisition, storage and application of the user's personal information involved are in compliance with relevant laws and regulations, and do not violate public order and good customs.

According to the embodiments of the present disclosure, the present disclosure also provides an electronic device, a readable storage medium and a computer program product.

Figure 6:
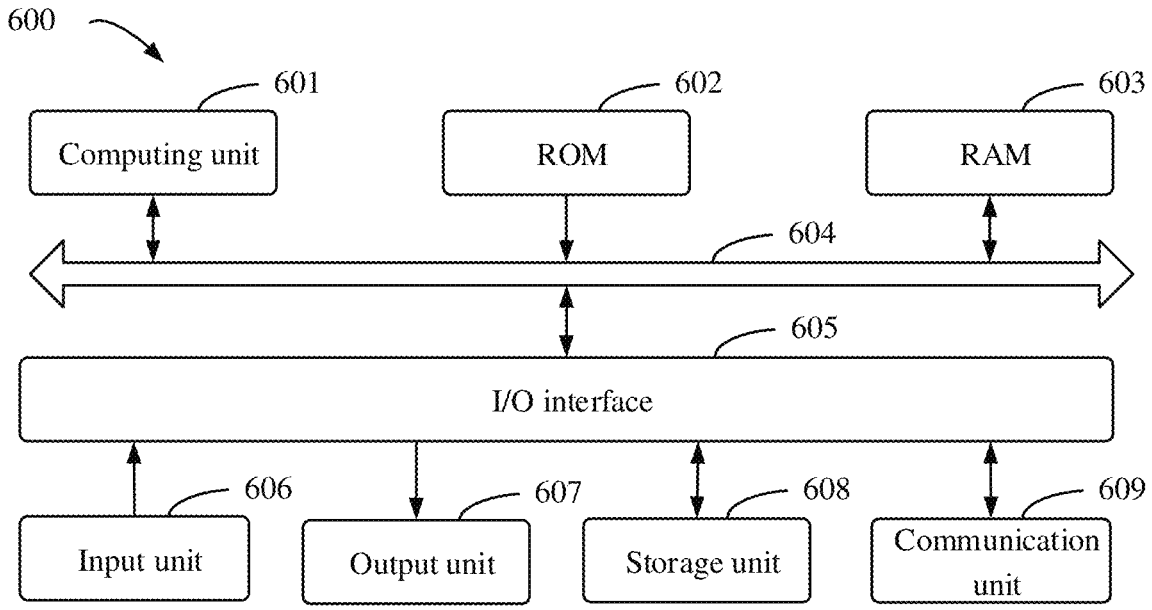
FIG. 6 is a block diagram of an electronic device according to an embodiment of the present disclosure.

FIG. 6 shows a schematic block diagram of an exemplary electronic device 600 that may be used to implement the embodiments of the present disclosure. The electronic device is intended to represent various forms of digital computers, such as a laptop, a desktop, a workstation, a personal digital assistant, a server, a blade server, a mainframe computer, and other suitable computers. The electronic device may also represent various forms of mobile devices, such as a personal digital assistant, a cellular phone, a smart phone, a wearable device and other similar computing devices. The components shown herein, their connections and relationships, and their functions are merely examples, and are not intended to limit the implementation of the present disclosure described and/or required herein.

As shown in FIG. 6, the device 600 includes a computing unit 601 that may perform various appropriate actions and processes according to a computer program stored in a Read-Only Memory (ROM) 602 or a computer program loaded from a storage unit 608 into a Random Access Memory (RAM) 603. Various programs and data required for an operation of device 600 may also be stored in the RAM 603. The computing unit 601, the ROM 602 and the RAM 603 are connected to each other through a bus 604. The input/output (I/O) interface 605 is also connected to the bus 604.

A plurality of components in the device 600 are connected to the I/O interface 605, and include an input unit 606 such as a keyboard, a mouse, or the like; an output unit 607 such as various types of displays, speakers, or the like; the storage unit 608 such as a magnetic disk, an optical disk, or the like; and a communication unit 609 such as a network card, a modem, a wireless communication transceiver, or the like. The communication unit 609 allows the device 600 to exchange information/data with other devices through a computer network such as the Internet and/or various telecommunication networks.

The computing unit 601 may be various general-purpose and/or special-purpose processing components with processing and computing capabilities. Some examples of the computing unit 601 include, but are not limited to, a Central Processing Unit (CPU), a Graphics Processing Unit (GPU), various dedicated Artificial Intelligence (AI) computing chips, various computing units that run machine learning model algorithms, a Digital Signal Processor (DSP), and any appropriate processors, controllers, microcontrollers, or the like. The computing unit 601 performs the various methods and processes described above, such as the yarn stripping method. For example, in some implementations, the yarn stripping method may be implemented as a computer software program tangibly contained in a computer-readable medium, such as the storage unit 608. In some implementations, a part or all of the computer program may be loaded and/or installed on the device 600 via the ROM 602 and/or the communication unit 609. When the computer program is loaded into the RAM 603 and executed by the computing unit 601, one or more steps of the yarn stripping method described above may be performed. Alternatively, in other implementations, the computing unit 601 may be configured to perform the yarn stripping method by any other suitable means (e.g., by means of firmware).

Various implementations of the system and technologies described above herein may be implemented in a digital electronic circuit system, an integrated circuit system, a Field Programmable Gate Array (FPGA), an Application Specific Integrated Circuit (ASIC), an Application Specific Standard Product (ASSP), a System on Chip (SOC), a Complex Programmable Logic Device (CPLD), a computer hardware, firmware, software, and/or a combination thereof. These various implementations may be implemented in one or more computer programs, and the one or more computer programs may be executed and/or interpreted on a programmable system including at least one programmable processor. The programmable processor may be a special-purpose or general-purpose programmable processor, may receive data and instructions from a storage system, at least one input device, and at least one output device, and transmit the data and the instructions to the storage system, the at least one input device, and the at least one output device.

The program code for implementing the method of the present disclosure may be written in any combination of one or more programming languages. The program code may be provided to a processor or controller of a general-purpose computer, a special-purpose computer or other programmable data processing devices, which enables the program code, when executed by the processor or controller, to cause the function/operation specified in the flowchart and/or block diagram to be implemented. The program code may be completely executed on a machine, partially executed on the machine, partially executed on the machine as a separate software package and partially executed on a remote machine, or completely executed on the remote machine or a server.

In the context of the present disclosure, a machine-readable medium may be a tangible medium, which may contain or store a procedure for use by or in connection with an instruction execution system, device or apparatus. The machine-readable medium may be a machine-readable signal medium or a machine-readable storage medium. The machine-readable medium may include, but is not limited to, an electronic, magnetic, optical, electromagnetic, infrared or semiconductor system, device or apparatus, or any suitable combination thereof. More specific examples of the machine-readable storage medium may include electrical connections based on one or more lines, a portable computer disk, a hard disk, a Random Access Memory (RAM), a Read-Only Memory (ROM), an Erasable Programmable Read-Only Memory (EPROM or a flash memory), an optical fiber, a portable Compact Disc Read-Only Memory (CD-ROM), an optical storage device, a magnetic storage device, or any suitable combination thereof.

In order to provide interaction with a user, the system and technologies described herein may be implemented on a computer that has: a display apparatus (e.g., a cathode ray tube (CRT) or a Liquid Crystal Display (LCD) monitor) for displaying information to the user; and a keyboard and a pointing device (e.g., a mouse or a trackball) through which the user may provide input to the computer. Other types of devices may also be used to provide interaction with the user. For example, feedback provided to the user may be any form of sensory feedback (e.g., visual feedback, auditory feedback, or tactile feedback), and the input from the user may be received in any form (including an acoustic input, a voice input, or a tactile input).

The system and technologies described herein may be implemented in a computing system (which serves as, for example, a data server) including a back-end component, or in a computing system (which serves as, for example, an application server) including a middleware, or in a computing system including a front-end component (e.g., a user computer with a graphical user interface or web browser through which the user may interact with the implementation of the system and technologies described herein), or in a computing system including any combination of the back-end component, the middleware component, or the front-end component. The components of the system may be connected to each other through any form or kind of digital data communication (e.g., a communication network). Examples of the communication network include a Local Area Network (LAN), a Wide Area Network (WAN), and the Internet.

A computer system may include a client and a server. The client and server are generally far away from each other and usually interact with each other through a communication network. A relationship between the client and the server is generated by computer programs running on corresponding computers and having a client-server relationship with each other. The server may be a cloud server, a distributed system server, or a blockchain server.

It should be understood that, the steps may be reordered, added or removed by using the various forms of the flows described above. For example, the steps recorded in the present disclosure can be performed in parallel, in sequence, or in different orders, as long as a desired result of the technical scheme disclosed in the present disclosure can be realized, which is not limited herein.

The foregoing specific implementations do not constitute a limitation on the protection scope of the present disclosure. Those having ordinary skill in the art should understand that, various modifications, combinations, sub-combinations and substitutions may be made according to a design requirement and other factors. Any modification, equivalent replacement, improvement or the like made within the principle of the present disclosure shall be included in the protection scope of the present disclosure.

What is claimed is:

1. A yarn box, comprising:

a support, comprising a bottom plate and a support plate perpendicular to the bottom plate, wherein a plurality of pulleys are provided on a bottom of the bottom plate away from the support plate;

at least one yarn receiving rod parallel to the bottom plate, wherein a first end of the at least one yarn receiving rod is connected to the support plate, and a second end of the at least one yarn receiving rod is configured to correspond to a discharge port of a doffer to enable a plurality of yarn spindles unloaded from the discharge port to be sleeved outside the at least one yarn receiving rod; wherein the yarn box stores or transfers the plurality of yarn spindles; and a yarn stripping rod parallel to the bottom plate, wherein a first end of the yarn stripping rod is slidably connected to the support plate, the yarn stripping rod is configured to slide to a yarn stripping position corresponding to a first yarn receiving rod among the at least one yarn receiving rod when the plurality of yarn spindles are sleeved outside the first yarn receiving rod and the number of yarn spindles of the first yarn receiving rod reaches a set condition, the yarn stripping rod is provided with a plurality of yarn strippers corresponding to the plurality of yarn spindles one by one, and a yarn stripper of the plurality of yarn strippers is configured to strip fiber yarn on an outer surface of a corresponding yarn spindle;

wherein the yarn stripping rod is further provided with a camera configured to photograph the plurality of yarn spindles sleeved outside the first yarn receiving rod, to obtain a yarn spindle image for determining a target yarn spindle with drooping fiber yarn among the plurality of yarn spindles; and the yarn stripper is telescopically connected to the yarn stripping rod, and the yarn stripper comprises a yarn adsorption device and a yarn cutting knife; wherein the yarn adsorption device is configured to adsorb an end of the drooping fiber yarn of the target yarn spindle when the yarn stripper extends from the yarn stripping rod towards the target yarn spindle so that the end is fixed on the yarn adsorption device, and drive the target yarn spindle to rotate in an opposite direction to a first direction so that the fiber yarn on the outer surface of the target yarn spindle is rolled out; and the yarn cutting knife is configured to cut fiber yarn connected between the yarn adsorption device and the target yarn spindle when adsorption time of the yarn adsorption device reaches a set threshold.

2. The yarn box of claim 1, wherein the first end of each yarn receiving rod is rotatably connected to the support, the yarn spindle image is further used to identify the first direction in which fiber yarn of the plurality of yarn spindles is wound into spindles, and the first yarn receiving rod is configured to rotate in an opposite direction of the first direction to rotate a yarn spindle sleeved outside the first yarn receiving rod and make fiber yarn wound on the yarn spindle hang down before determining the target yarn spindle with drooping fiber yarn among the plurality of yarn spindles.

3. The yarn box of claim 1, wherein the first yarn receiving rod is further configured to, when the yarn adsorption device adsorbs the fiber yarn on the outer surface of the target yarn spindle, rotate in the opposite direction to the first direction to rotate the target yarn spindle so that the fiber yarn on the outer surface of the target yarn spindle is rolled out.

4. The yarn box of claim 1, wherein the yarn stripper is slidably connected to the yarn stripping rod, and the yarn stripper is configured to, when the corresponding yarn spindle is the target yarn spindle, slide on the yarn stripping rod to calibrate corresponding positions of the yarn stripper and the target yarn spindle.

5. The yarn box of claim 1, further comprising:

a waste yarn container located below the yarn stripping rod, having a container opening facing the yarn stripping rod, and configured to collect the fiber yarn stripped by the yarn stripper; wherein the container opening is a funnel opening; and/or a vacuum adsorber with a suction nozzle disposed on an inner side of the waste yarn container and close to the container opening, wherein the vacuum adsorber is configured to adsorb the fiber yarn stripped by the yarn stripper, to collect the stripped fiber yarn in the waste yarn container.

6. The yarn box of claim 1, wherein, the first end of the at least one yarn receiving rod is connected to the support plate, and the first end of the yarn stripping rod is slidably connected to the support plate.

7. A yarn stripping method, comprising:

controlling the discharge port of the doffer to correspond to a second end of the first yarn receiving rod in the yarn box of claim 1;

controlling the doffer to unload the plurality of yarn spindles from the discharge port so that the plurality of yarn spindles are sleeved outside the first yarn receiving rod, wherein the yarn box stores or transfers the plurality of yarn spindles;

controlling the yarn stripping rod in the yarn box to slide to the yarn stripping position corresponding to the first yarn receiving rod when the number of yarn spindles of the first yarn receiving rod reaches the set condition;

controlling the camera to photograph the plurality of yarn spindles sleeved outside the first yarn receiving rod to obtain a first yarn spindle image;

determining the target yarn spindle with drooping fiber yarn among the plurality of yarn spindles according to the first yarn spindle image;

controlling the yarn stripper corresponding to the target yarn spindle to extend from the yarn stripping rod towards the target yarn spindle;

controlling the yarn adsorption device in the yarn stripper to adsorb the end of the drooping fiber yarn of the target yarn spindle so that the end is fixed on the yarn adsorption device, and controlling the yarn adsorption device to drive the target yarn spindle to rotate in an opposite direction to the first direction so that the fiber yarn on the outer surface of the target yarn spindle is rolled out; and controlling the yarn cutting knife in the yarn stripper to cut fiber yarn connected between the yarn adsorption device and the target yarn spindle when adsorption time of the yarn adsorption device reaches the set threshold.

8. The method of claim 7, wherein the plurality of yarn strippers are slidably connected to the yarn stripping rod, and the method further comprises:

before controlling the yarn stripper corresponding to the target yarn spindle to extend from the yarn stripping rod, controlling the yarn stripper corresponding to the target yarn spindle to slide on the yarn stripping rod to calibrate corresponding positions of the yarn stripper and the target yarn spindle.

9. The method of claim 7, wherein the determining a target yarn spindle with drooping fiber yarn among the plurality of yarn spindles according to the first yarn spindle image, comprises:

inputting the first yarn spindle image into an image recognition model to obtain a first detection frame image output by the image recognition model, wherein the first detection frame image comprises the first yarn spindle image and at least one detection frame comprising any drooping fiber yarn in the first yarn spindle image; and determining the target yarn spindle among the plurality of yarn spindles based on position information of each detection frame in the first detection frame image.

10. The method of claim 9, further comprising:

obtaining a second yarn spindle image and a third yarn spindle image, wherein the second yarn spindle image and the third yarn spindle image are obtained by shooting all yarn spindles on the same yarn receiving rod from two different shooting angles;

inputting the second yarn spindle image into the image recognition model to obtain a second detection frame image output by the image recognition model, wherein the second detection frame image comprises the second yarn spindle image and at least one detection frame comprising any drooping fiber yarn in the second yarn spindle image;

inputting the third yarn spindle image into the image recognition model to obtain a third detection frame image output by the image recognition model, wherein the third detection frame image comprises the third yarn spindle image and at least one detection frame comprising any drooping fiber yarn in the third yarn spindle image;

determining a first loss function based on position information of each detection frame in the second detection frame image and position information of each detection frame in the third detection frame image; and adjusting a model parameter of the image recognition model based on the first loss function.

11. The method of claim 7, wherein a first end of the first yarn receiving rod is rotatably connected to a support rod in the yarn box, and the method further comprises:

identifying a first direction in which fiber yarn of the plurality of yarn spindles is wound into spindles according to the first yarn spindle image; and rotating in an opposite direction of the first direction to rotate a yarn spindle sleeved outside the first yarn receiving rod and make fiber yarn wound on the yarn spindle hang down before determining the target yarn spindle with drooping fiber yarn among the plurality of yarn spindles.

12. The method of claim 7, further comprising:

when the yarn adsorption device adsorbs the fiber yarn on the outer surface of the target yarn spindle, controlling the first yarn receiving rod to rotate in the opposite direction to the first direction to rotate the target yarn spindle so that the fiber yarn on the outer surface of the target yarn spindle is rolled out.

13. The method of claim 7, wherein the yarn box further comprises a waste yarn container located below the yarn stripping rod and having a container opening facing the yarn stripping rod, and a vacuum adsorber with a suction nozzle disposed on an inner side of the waste yarn container and close to the container opening; and the method further comprises:

controlling the vacuum adsorber to adsorb the fiber yarn stripped by the yarn stripper, to collect the stripped fiber yarn in the waste yarn container.

* * * * *